US009492996B2

(12) United States Patent
Clarke et al.

(10) Patent No.: US 9,492,996 B2
(45) Date of Patent: Nov. 15, 2016

(54) WEB CONTROL TO REDUCE WASTE AND METHOD

(71) Applicant: Goss International Americas, Inc., Durham, NH (US)

(72) Inventors: Thomas Bowen Clarke, Durham, NH (US); Peter W. Walczak, Jr., Lee, NH (US); Jeffrey S. Upchurch, Stratham, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 14/136,210

(22) Filed: Dec. 20, 2013

(65) Prior Publication Data

US 2014/0182470 A1 Jul. 3, 2014

Related U.S. Application Data

(60) Provisional application No. 61/747,774, filed on Dec. 31, 2012.

(51) Int. Cl.

| | |
|---|---|
| ***B41F 33/06*** | (2006.01) |
| ***B41F 13/04*** | (2006.01) |
| ***B41F 13/24*** | (2006.01) |
| ***B41F 33/00*** | (2006.01) |

(52) U.S. Cl.

CPC ..... *B41F 33/0036* (2013.01); *B41F 13/04* (2013.01); *B41F 13/24* (2013.01); *B41F 33/06* (2013.01); *B41P 2233/10* (2013.01); *B41P 2235/22* (2013.01); *B65H 2403/942* (2013.01); *B65H 2801/21* (2013.01)

(58) Field of Classification Search

CPC ..... B41F 33/06; B41F 33/16; B41F 33/0036; B41F 13/24; B41F 13/04; B41F 7/025; B41F 7/12; B41P 2233/10; B41P 2235/22

See application file for complete search history.

(56) References Cited

U.S. PATENT DOCUMENTS

| | | | | |
|---|---|---|---|---|
| 5,412,577 | A * | 5/1995 | Sainio et al. | 700/124 |
| 6,053,107 | A | 4/2000 | Hertel et al. | |
| 6,273,356 | B1 | 8/2001 | Burton | |
| 6,796,240 | B2 * | 9/2004 | Sainio et al. | 101/485 |
| 7,513,196 | B2 * | 4/2009 | Budach et al. | 101/485 |
| 8,042,910 | B2 | 10/2011 | Ray et al. | |

(Continued)

FOREIGN PATENT DOCUMENTS

| | | |
|---|---|---|
| CA | 2154012 | 1/1996 |
| FR | 2 383 784 | 10/1973 |
| GB | 1557652 A * | 12/1979 |

*Primary Examiner* — Jennifer Simmons
*Assistant Examiner* — Leo T Hinze
(74) *Attorney, Agent, or Firm* — Davidson, Davidson & Kappel, LLC

(57) ABSTRACT

A method is provided which reduces substrate waste while adjusting the press parameters to obtain a satisfactory image. The method includes the steps of: supplying a web to a printing press; printing a plurality of first images on the web at corresponding printing positions; inspecting one of the first images on the web; rewinding the web to one of the printing positions; and printing a further image over one of the first images on the web. A printing press is also provided which is configured and arranged to print in accordance with the method.

13 Claims, 3 Drawing Sheets

(56) References Cited

U.S. PATENT DOCUMENTS

| | | | | |
|---|---|---|---|---|
| 8,240,843 | B2 | 8/2012 | Ray | |
| 2007/0012210 | A1* | 1/2007 | Lundin et al. | 101/425 |
| 2011/0006148 | A1 | 1/2011 | Tolrud et al. | |
| 2011/0168042 | A1 | 7/2011 | Guaraldi et al. | |
| 2011/0297023 | A1 | 12/2011 | Meissner | |

* cited by examiner

WEB CONTROL TO REDUCE WASTE AND METHOD

This application claims priority to U.S. Provisional Application Ser. No. 61/747,774, filed Dec. 31, 2012, the entire disclosure of which is hereby incorporated by reference.

The present invention relates generally to printing presses.

BACKGROUND

U.S. Pat. No. 6,053,107 purportedly discloses a preprinted web having a plurality of first repeating images being reprinted with a plurality of second repeating images which are in register with the first images. A register mark is printed on the web for each of the first images. When the web is reprinted, the positions of the register marks are sensed and compared with the positions of the second images, and the unwind tension of the web is adjusted to maintain the relative positions substantially constant.

U.S. Pat. No. 8,240,843 purportedly discloses a dual web winder device for a web press that includes a pair of drive motors and a pair of shafts. Each shaft is coupled to one of the drive motors and configured to carry a roll of web media. The shafts and drive motors are synchronized to simultaneously unwind a first roll of web media from one shaft and rewind a second roll of web media on the other shaft.

BRIEF SUMMARY OF THE INVENTION

The cost of printing substrates, for example, paper webs is high in the printing arts. Cost savings may be generated by reducing the amount of web material that is wasted. Web material may be wasted during startup of the press, changes between print jobs or when components of the printing press need to be replaced or exchanged.

In accordance with a first embodiment of the present invention, a printing press is provided which includes a web supply supplying a web to the press; at least one printing unit (preferably a plurality of printing units) configured and arranged to print images on the web; an inspection unit configured and arranged to inspect the images on the web; a rewind device configured and arranged to rewind the web to one of the printing positions; and a controller. The controller is coupled to the at least one printing unit (or to the plurality of printing units) and the rewind device, and the controller configured and arranged to control the at least one printing unit (or the plurality of printing units) to print first images on the web at corresponding printing position, and, after the inspection unit inspects the images on the web, control the rewind device to rewind the web to one of the printing positions, and thereafter, control the at least one printing unit (or the plurality of printing units) to print at least one further image over at least one of the first images on the web.

In accordance with another aspect of the first embodiment, the printing position is a position of the web with respect to one of the printing units.

In accordance with another aspect of the first embodiment, the controller is configured to record or determine a number of first images that are printed on the web and control an amount of web to rewind based on the number of first images printed on the web.

In accordance with another aspect of the first embodiment, the controller further controls printing the at least one further images so at least one of the further images is printed on an unprinted area of the web.

In accordance with another aspect of the first embodiment, each printing unit includes a plate cylinder and a blanket cylinder, an ink removal device configured and arranged to selectively contact one of the plate cylinder and the blanket cylinder, and a throw off mechanism configured and arranged to selectively separate the blanket cylinder from the web. The controller is configured and arranged to control the throw off mechanism to separate the blanket cylinder from the web, and while the blanket cylinder is separated from the web, control the ink removal device to contact one of the plate cylinder and the blanket cylinder.

In accordance with another aspect of the first embodiment, the ink removal device is configured to selectively contact the blanket cylinder, and the blanket cylinder includes a printing blanket. The ink removal device includes a roller, and the ink removal device is configured and arranged to selectively move the roller into rolling contact with the printing blanket of the blanket cylinder.

In accordance with another aspect of the first embodiment, the ink removal device is configured to selectively contact the plate cylinder, the plate cylinder includes a printing plate, and the ink removal device is configured and arranged to selectively contact the printing plate of the plate cylinder.

In accordance with a second embodiment of the present invention, a method for printing an image comprising the steps of: supplying a web to a printing press; printing a plurality of first images on the web at corresponding printing positions; inspecting one of the first images on the web; rewinding the web to one of the printing positions; and printing a further image over one of the first images on the web.

In accordance with a third embodiment of the present invention, a method for printing an image comprising the steps of: moving a web in a first direction; printing a first image on the web moving in the first direction; rewinding the web; moving the web in the first direction; and printing a further image on the web moving in the first direction. The printing may be performed by a printing unit of a printing press.

In accordance with another aspect of the second or third embodiment, the method may further comprise making adjustments to the printed image or printing press after the first image is printed on the web.

In accordance with another aspect of the second or third embodiment, the printing press may include a printing unit having a plate cylinder and a blanket cylinder, and the method may further comprise: after the step of printing the plurality of first images and before the step of rewinding the web: separating the blanket cylinder from the web using a throw off mechanism, moving an ink removal device into contact with one of the plate cylinder or blanket cylinder, and removing ink from said one of the plate cylinder or the blanket cylinder with the ink removal device; and after the step of rewinding and before the step of printing the further image: moving the ink removal device out of contact with said one of the plate cylinder or blanket cylinder, and bringing the blanket cylinder into contact with the web using the throw off mechanism. Further, after the step of inspecting and before the step of printing the further image, the method may include adjusting individual ink zones in the printing unit.

In accordance with another aspect of the second or third embodiment, the ink removal device may move into and out of contact with a printing blanket of the blanket cylinder, and the step of moving may further include: moving a roller in the ink removal device into rolling contact with the printing blanket of the blanket cylinder to remove ink from the printing blanket.

In accordance with another aspect of the second or third embodiment, the ink removal device may move into and out of contact with a printing plate of the plate cylinder, and the step of moving may further include: moving the ink removal device into contact with the printing plate of the plate cylinder to remove ink from the printing plate.

The present invention can reduce the amount of substrate required for the printing press to reach saleable copy. Since the amount of substrate used prior to saleable copies being printed is wasted, reducing the amount of substrate used during this time reduces waste. In accordance with the present invention, the motion of the substrate is controlled. The acceleration, deceleration and transport direction can be controlled to minimize the total amount of web substrate required to reach the desired state of printing.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
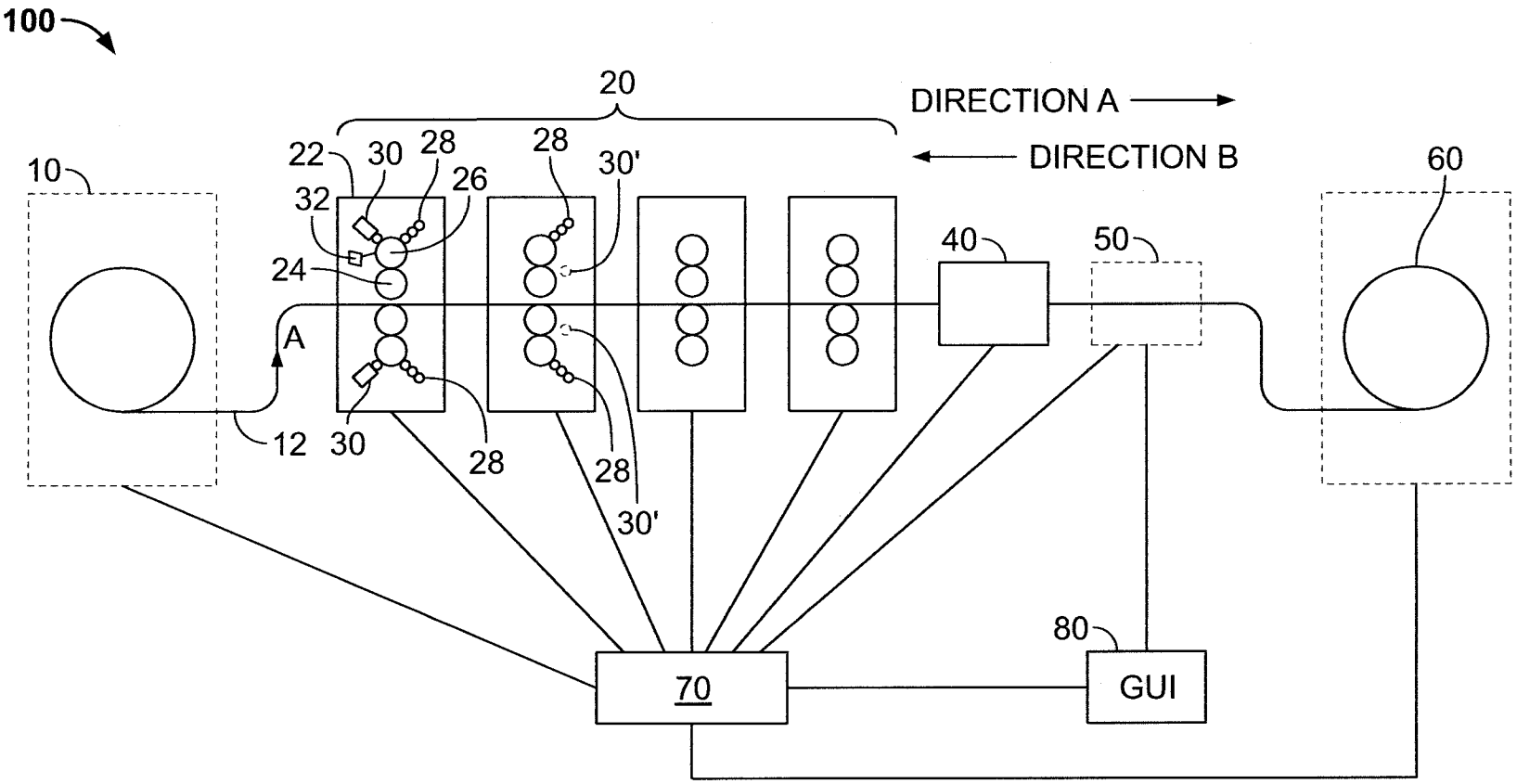
FIG. 1 shows a printing press according to the present invention.

FIG. 1 shows a printing press 100 in accordance with the present invention. The printing press 100 includes a substrate supply 10 for providing a substrate to the printing press for printing thereon. The substrate may be a paper web substrate 12 or other suitable printing substrate. The web substrate 12 is fed from web supply and infeed 10 through a printing section 20 of the printing press 100 then through to any post print processing stations 40 which may include, for example, a dryer and/or a chill roll stand. The web 12 is then passed through an inspection station 50. A web rewind unit 60 is located downstream of the inspection station 50.

Printing section 20 may include a plurality of printing units 20. The printing units maybe perfecting or non-perfecting print units. The printing units may be offset print units as shown. Each printing unit 20 includes a plate cylinder 26 and a blanket cylinder 24. For perfecting print units, an additional print couple is provided on the lower side of the web. For non-perfecting print units, an impression cylinder may be provided to counteract the blanket cylinder. Each print unit may print a different color, for example, cyan, magenta, yellow or black.

An inking device 28 is associated with each plate cylinder 26 as is known in the art. For example, inking device 28 may include an ink train and a dampening train in the case of an offset lithographic printing press as is well known in the art. Ink removal device 30 is associated with the plate cylinder 26 or the blanket cylinder 24. Schematically shown ink removal device 30 may, for example provide washing solution or wetting solution to the printing plate, and may include nozzles for applying the solution and a cleaning cloth or roller for removing the ink and washing/wetting solution, and optionally a dryer for drying the plate. An example of such a conventional ink removal device is described in CA 2,154,012, incorporated herein by reference. Alternatively, ink removal device 30 may be an ink take-away roller 30'(shown in dotted lines) as is known in the art for removing ink from the blanket cylinder or plate cylinder. An example of an ink takeaway roller is described in U.S. Pat. No. 5,235,913, the entire disclosure of which is hereby incorporated by reference. As one of ordinary skill in the art with appreciate, the ink removal device (30, 30') contacts the printing plate of the plate cylinder or the printing blanket of the blanket cylinder to remove ink from the printing plate or printing blanket, and is spaced apart from the plate cylinder or blanket cylinder when the printing unit is printing on the web.

Figure 2A:
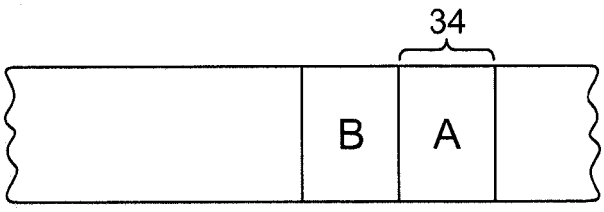
FIGS. 2A to 2D shows an array of images printed according to the present invention.

In accordance with the present invention, printing units 22 of print section 20 and post processing stations 40 are brought online to prepare for printing a first job. Printing units 22 and processing stations 40 are brought up to operating speed without running web 12. Once these components of press 100 are running at operating speed, web 12 is fed from supply 10 into printing section 20 in a direction A. Thus, the speed of the web 12 matches the speed of the press components 22, 40 and printing begins. A first image is printed on web 12 at an initial or first printing position 34. Images are printed on web 12, until an image acceptable for inspection is printed; for example, image B shown in FIG. 2A. Printing a minimum number of images is desired to reduce the amount of web consumed and amount of ink used. As shown in FIG. 2A, two images, image A and image B were printed. Preferably, less than 5 images or impressions are printed.

Once a test image acceptable for inspection is printed, web 12 is stopped as quickly as possible. Printing units 22 may continue to run while the web is stopped. To accommodate this, printing units 22 may be thrown off web 12 so as to not interfere with the stopped web 12.

Throw-off mechanisms are well known in the art and will not be discussed in detail herein. For example, in a non-perfecting press, moving the impression cylinder out of contact with the blanket cylinder will typically cause the blanket cylinder to come out of contact with the web. Alternatively, the blanket cylinder could be moved upward out of contact with the impression cylinder while the impression cylinder either remains in a fixed position or moves downward. This may or may not require movement of the plate cylinder , ink train, and/or dampening train . For example, depending on the arrangement, blanket cylinder could move in an arcuate upward path while the plate cylinder remains in place. In a perfecting printing unit, the upper blanket cylinder would move upward and/or the lower blanket cylinder would move downward. Depending on the arrangement of the plate cylinder, ink train and dampener train, these components may also move when the printing unit is taken off impression. There are a wide variety of well-known mechanisms that can be used to effect throw off. Non-limiting examples include mounting the plate and/or blanket cylinders in eccentric bearings, mounting the plate and/or blanket cylinders on pivotable brackets, mounting the cylinders on tracks or carriages, and combinations of the foregoing. These mechanisms can be actuated by the controller 70 with a wide variety of actuators, including motors, hydraulic cylinders, pneumatic cylinders, and the like.

While the web is stopped and the printing units continue to run, ink removal or wetting devices 30, 30' may also continue to run to keep the plate cylinders and/or blanket cylinders clean and/or from carrying surplus ink. Test image B is inspected while web 12 is stopped by inspection unit 50. The ink removal devices 30 or 30' may be moved into contact with the plate cylinder or blanket cylinder to clean the cylinders, and may be moved out of contact with the plate cylinder or blanket cylinder to allow printing.

Inspection unit 50 may be any type of substrate inspection device, as known in the art. For example, inspection unit 50 may be a visual inspection unit in which a press operator visually inspects the web onsite. Inspection unit 50 may also include cameras and/or a graphic user interface so a press operator may review and inspect web 12 at a remote location. Inspection unit 50 may be digital. Unit 50 may scan web 12 and compare the actual web 12 with stored metrics or a known desired result. Many qualities may affect the quality of the printed image including, for example, qualities of the ink, such as the color array, optical density, dot shape, dot gain, ink trapping, doubling, ghosting, evenness of ink distribution, other qualities of the printed image may also include resolution including sharpness and gradation, registration including dot/color registration and printed image registration other qualities may include clarity of the image. Surface characteristics such as gloss, mottling and evenness may also be inspected. Any conceivable or desired characteristic of the web, image, ink, etc. may be reviewed or inspected.

Printing a color control bar in trim areas of the printed image is a desired way to review and achieve color printing and accuracy. On a multicolor press the application of ink in each color may need to be monitored and adjusted individually. Targeted adjustments and controls of individual ink zones and ink fountains may be made based on the color control bar and the printed areas associated with each ink zone and ink fountain.

If the print quality of image B passes inspection, web 12 is accelerated to match the press speed including the speed of printing units 22. Printing units 22 are moved back into printing position, thrown-on, as known in the art, the ink removal devices 30 (or 30') are disengaged, and the printing press continues printing images on web 12. Since web 12 was stopped during the inspection of image B, web 12 did not run continuously and superfluously through press 100. As a result, the amount of web 12 wasted is hereby reduced when compared to conventional methods in which web 12 continues to run through press 100.

Figure 2B:
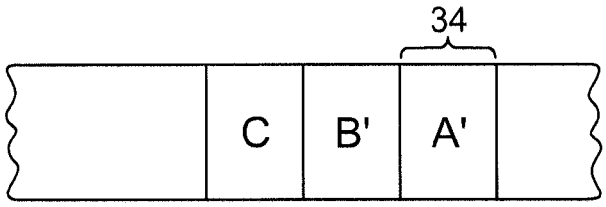

When image B is not acceptable and/or does not pass inspection, another test image suitable for inspection must be printed on web 12. In order to reduce the amount of web wasted, web substrate 12 is rewound in direction B to a first printing position 34 where a further image will be printed over the first image A. In accordance with the present invention, web 12 is accelerated up to the matched velocity of press 100 and web 12 will be printed upon by the first printing unit 22. A second image A' is printed on web 12 over the first image A at first printing position 34 on web 12. See FIG. 2B. A second image B' is printed over the first image B. A third image C is printed on an unprinted area of web 12. Image C becomes the first image suitable for inspection during this second round of printing since image C is the only image printed on a clean, unused portion of web 12.

In order to rewind and align web 12 to the proper position for printing by printing unit 22 a plurality of methods may be used. For example, plate cylinder 26 may include an encoder 32 which counts the number of images A, B (See FIGS. 2A to D) printed on a given length of web 12. Encoder 32 counts two images A, B printed on web 12. Web 12 is then rewound by web supply 10 two image/impression lengths. Other methods for aligning a web may also be used. For example, registration marks may be used to rewind web 12 to the first printing position 34 with respect to printing unit 22. The length of web rewind may also be estimated based on speed set points or speed command values, for example, estimated acceleration of the web and time elapsed.

Figure 2C:
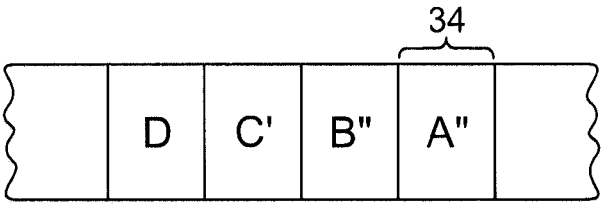
Figure 2D:
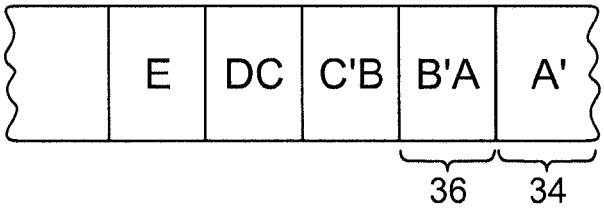

If image C fails inspection, web 12 is rewound again to the first image printing position 34 so a third image, image A" is printed over image A and image A' as shown in FIG. 2C. A third image B" is printed over image B and image B' and a second image C' is printed over image C. The first new image suitable for inspection is image D. If desired, web 12 may be rewound to the second image printing position 36 and reprinting may begin over images B, B' instead rewinding the web all the way back to the initial or first image printing position 34. See for example, FIG. 2D, in which a third image A is printed over first and second images B, B'. It is not necessary for second or third images to be exactly and precisely aligned with previous images on web 12. On the contrary, the re-printed web will be discarded so registration of second and third images over first and second images, respectively, does not need to be precise.

Web 12 may move in either direction, direction A or the opposite direction B. Controller 70 may move web 12 in direction A during a printing operation. Controller 70 may move in web 12 in the opposite direction B to rewind web 12 to a previous printing position 34, 36. Controller 70 in conjunction with encoder 32 may record the number of impressions or images A, B, etc. printed on web 12 until an acceptable test image B is printed. Controller 70 then controls the rewinding of web 12 based on the number of images or impressions printed. Controller 70 may also control the further printing on web 12 to ensure that a second test image is printed on a clean or unused portion of web 12. Thus, controller 70 may record the number of images first printed on the web, control a length of web to be rewound based on the number of first printed images, then control the number of second images printed on the web to ensure at least one second image is printed on a clean or unprinted area of web 12. Movement of the ink removal devices 30, 30' may also be controlled by the controller 70. The throw-off mechanisms discussed above can also be controlled by the controller 70.

Web 12 can be moved in the forward (A) or reverse (B) direction through the press as is known in the art. To move the web 12 in the forward direction A while the printing units are thrown off the web, the controller 70 will instruct one or more driven rollers downstream of the printing units to rotate, thereby pulling the web in the forward direction A through the printing units and towards the rewind unit 60. The downstream rollers may, for example, be in a driven nip roller pair in a chill roll stand or be the rewind unit itself, or nip roller pairs in or upstream of the rewind unit. To the move the web in the reverse direction B, while the printing units are thrown off the web, the controller 70 will instruct one or more driven rollers upstream of the printing units to rotate in reverse (as compared to the rotation of these rollers during printing) thereby pulling the web in the reverse direction B through the printing units and towards the roll stand 10. The upstream rollers may, for example, be a driven nip roller pair in an infeed.

A graphic user interface 70 may be employed to interact with a user or press operator. User input may be desired for web and image inspection. The user or press operator may determine if a further test image suitable for inspection needs to be printed.

After image inspection and during web rewind, printing unit inkers and post unit processors may be adjusted based on the results of the inspection and any deviations from the desired results.

Figure 3:
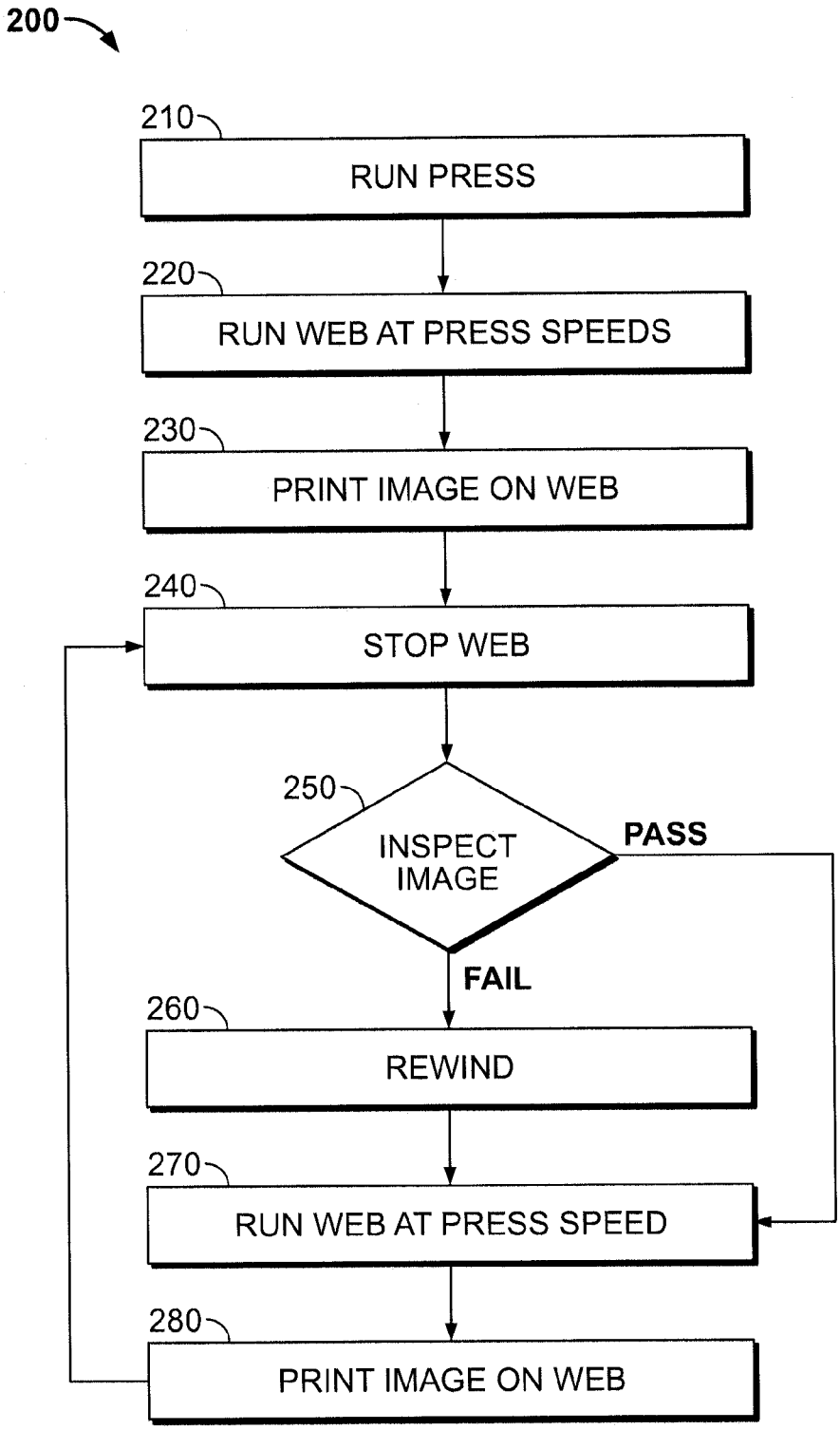
FIG. 3 shows a flow chart according to the present invention.

As shown in FIGS. 1 and 3, the printing, inspection and rewind process may be repeated as desired. In accordance with a method of the present invention, printing press 100 is brought up to the desired press speed 210, web 12 is then subsequently brought up to press speed 220 and images are printed on the web 230. Once a test image is printed, the web is stopped 240 and the image and/or web are inspected 250. If needed, web 12 is rewound 260 to an initial or previous printing position 34, 36. Adjustments may be made to any of the press components after inspection. Web 12 is brought up to press speed again 270 and further printing begins 280. Successive images printed on web 12 are printed over previously printed portions of web 12, with new test images to be inspected being printed on clean portions of web 12. If test images pass inspection, web 12 is not rewound. Web 12 is brought up to press speed 270 and printing continues 280. The web stopping, rewind, and printing loop may be repeated as many times as desired until an acceptable or desired image is printed.

By rewinding the web to an initial or previous printing position, multiple images and process adjustments consume only a minimal amount of substrate web. No additional substrate is consumed during the inspection process since the web is stopped during inspection. Inspection can verify all processes not limited to correct image, ink coverage, web coating, image numbering, digital imaging, etc.

It should be noted that the manner in which a controller, such as controller 70 can be configured to control printing units 22 to throw-off the web, control ink removal devices 30, 30' and to move the web in the forward direction A and the reverses direction B is well known in the art, and therefore will not be recounted herein. Rather, the embodiments of the present invention are directed to a novel system for reaching a saleable copy during make-ready or startup with reduced waste. In this regard, controller 70 can, for example, be one or more programmable logic controller(s) (PLC), or any suitable hardware based or software based electronic controller or controllers including, for example, one or more microcomputers with related support circuitry, one or more finite static machine(s), one or more field programmable gate array(s), FPGA, or one or more application-specific integrated circuit(s), ASIC, among others.

Although FIGS. 1-7 illustrate the present invention in the context of a web offset lithographic press, it should be appreciated that the present invention can be applied to any type of web press including without limitation flexographic presses, gravure presses, digital presses, and ink jet presses. Further, the presses may include a single printing unit or a plurality of printing units. Moreover, it should be understood that the web itself could be any continuous substrate to be printed, included without limitation, paper, plastic, cardboard, corrugated cardboard, and the like.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press comprising:

a web supply supplying a web to the press;

at least one printing unit configured and arranged to print images on the web at corresponding printing positions;

an inspection unit configured and arranged to inspect the images on the web;

a rewind device configured and arranged to rewind the web to one of the printing positions;

a controller, the controller coupled to the at least one printing unit and the rewind device, the controller configured and arranged to control the at least one printing unit to print first images on the web at corresponding printing positions, and, after the inspection unit inspects the first images on the web and a determination is made using the inspection unit that the first images are not acceptable, control the rewind device to rewind the web to one of the printing positions, and thereafter, prior to printing at least one further image, control the at least one printing unit to make adjustments to the printed image or the at least one printing unit, and thereafter, control the at least one printing unit to print at least one further image over at least one of the first images on the web.

2. The printing press as recited in claim 1 wherein the at least one printing unit is a plurality of printing units.

3. The printing press as recited in claim 2 wherein the printing position is a position of the web with respect to one of the printing units.

4. The printing press as recited in claim 3 wherein the controller further controls printing the at least one further images so at least one of the further images is printed on an unprinted area of the web.

5. The printing press according to claim 2, wherein each printing unit includes:

a plate cylinder and a blanket cylinder, an ink removal device configured and arranged to selectively contact one of the plate cylinder and the blanket cylinder, and a throw off mechanism configured and arranged to selectively separate the blanket cylinder from the web; and wherein the controller is configured and arranged to control the throw off mechanism to separate the blanket cylinder from the web, and while the blanket cylinder is separated from the web, control the ink removal device to contact one of the plate cylinder and the blanket cylinder.

6. The printing press of claim 5, wherein said one of the plate cylinder and the blanket cylinder is the blanket cylinder;

wherein the blanket cylinder includes a printing blanket; and wherein the ink removal device includes a roller, and wherein the ink removal device is configured and arranged to selectively move the roller into rolling contact with the printing blanket of the blanket cylinder.

7. The printing press of claim 5, wherein said one of the plate cylinder and the blanket cylinder is the plate cylinder; wherein the plate cylinder includes a printing plate; and wherein the ink removal device is configured and arranged to selectively contact the printing plate of the plate cylinder.

8. The printing press as recited in claim 1 wherein the controller is configured to record or determine a number of first images that are printed on the web and control an amount of web to rewind based on the number of first images printed on the web.

9. A method for printing an image comprising the steps of:

supplying a web to a printing press;

printing a plurality of first images on the web with at least one printing unit at corresponding printing positions;

inspecting one of the first images on the web with an inspection unit;

rewinding the web with a rewind device to one of the printing positions; and providing a controller, the controller coupled to the at least one printing unit and the rewind device, the controller configured and arranged to control the at least one printing unit to print first images on the web at corresponding printing positions, and, after the inspection unit inspects the first images on the web and a determination is made using the inspection unit that the first images are not acceptable, control the rewind device to rewind the web to one of the printing positions, and thereafter, prior to printing at least one further image, control the at least one printing unit to make adjustments to the printed image or the at least one printing unit, and thereafter, control the at least one printing unit to print at least one further image over at least one of the first images on the web.

10. The method of claim 9, wherein the printing press includes a printing unit having a plate cylinder and a blanket cylinder, the method further comprising:

after the step of printing the plurality of first images and before the step of rewinding the web:

separating the blanket cylinder from the web using a throw off mechanism, moving an ink removal device into contact with one of the plate cylinder or blanket cylinder, and removing ink from said one of the plate cylinder or the blanket cylinder with the ink removal device; and after the step of rewinding and before the step of printing the further image:

moving the ink removal device out of contact with said one of the plate cylinder or blanket cylinder, and bringing the blanket cylinder into contact with the web using the throw off mechanism.

11. The method of claim 10, further comprising, after the step of inspecting and before the step of printing the further image, adjusting individual ink zones in the printing unit.

12. The method of claim 10, wherein said one of the plate cylinder and the blanket cylinder is the blanket cylinder, the blanket cylinder including a printing blanket, and wherein the step of moving includes:

moving a roller in the ink removal device into rolling contact with the printing blanket of the blanket cylinder to remove ink from the printing blanket.

13. The method of claim 10, wherein said one of the plate cylinder and the blanket cylinder is the plate cylinder, the plate cylinder including a printing plate, and wherein the step of moving includes:

moving the ink removal device into contact with the printing plate of the plate cylinder to remove ink from the printing plate.

* * * * *